US010750804B2

(12) United States Patent
Ji

(10) Patent No.: US 10,750,804 B2
(45) **Date of Patent: *Aug. 25, 2020**

(54) PROCESS FOR PRODUCING A KNITTED SWEATBAND

(71) Applicant: Jun Ji, Rugao (CN)

(72) Inventor: Jun Ji, Rugao (CN)

( * ) Notice: Subject to any disclaimer, the term of this patent is extended or adjusted under 35 U.S.C. 154(b) by 404 days.

This patent is subject to a terminal disclaimer.

(21) Appl. No.: 15/581,282

(22) Filed: Apr. 28, 2017

(65) Prior Publication Data

US 2018/0206564 A1 Jul. 26, 2018

(30) Foreign Application Priority Data

Jan. 20, 2017 (CN) ..... 2017 1 0041546

(51) Int. Cl.

| | |
|---|---|
| ***A41D 20/00*** | (2006.01) |
| ***D01H 13/30*** | (2006.01) |
| ***D04B 1/24*** | (2006.01) |
| ***D06M 13/02*** | (2006.01) |
| ***D06M 13/203*** | (2006.01) |
| ***D06M 13/513*** | (2006.01) |

(Continued)

(52) U.S. Cl.

CPC ..... *A41D 20/00* (2013.01); *A41D 31/102* (2019.02); *A41D 31/12* (2019.02); *D01H 13/308* (2013.01); *D04B 1/16* (2013.01); *D04B 1/24* (2013.01); *D06M 13/02* (2013.01); *D06M 13/203* (2013.01); *D06M 13/513* (2013.01); *A41D 2500/10* (2013.01); *D06M 2101/32* (2013.01); *D06M 2200/40* (2013.01)

(58) Field of Classification Search

CPC . D06B 3/04; D06B 3/045; D06B 3/06; D06B 3/08; D06B 3/09; D01H 13/302; D01H 13/306; D01H 13/308; D04B 21/207; A42B 1/041; A42C 1/00; A42C 1/08

USPC ..... 252/8.84; 106/245; 2/200.1

See application file for complete search history.

(56) References Cited

U.S. PATENT DOCUMENTS 2,224,665 A * 12/1940 Bradshaw ..... D02H 3/00 242/166

2,272,588 A * 2/1942 Simison ..... C03C 25/20 118/125

(Continued)

FOREIGN PATENT DOCUMENTS

| | | |
|---|---|---|
| CN | 102162145 | 8/2011 |
| JP | 03234811 | 10/1991 |

OTHER PUBLICATIONS

Pending U.S. Appl. No. 15/498,895, filed Apr. 27, 2017.

(Continued)

*Primary Examiner* — Clinton T Ostrup
*Assistant Examiner* — Patrick J. Lynch

(57) ABSTRACT

The present invention generally relates to the production of knitted sweatbands that exhibit superior elasticity and breathability. Generally, the manufacturing process for producing the knitted sweatbands involves: (1) applying a continuous wax coating onto a polyester yarn; (2) twisting the yarn with one or more additional yarns to produce a twisted yarn; (3) knitting the twisted yarn into a sweatband body; and (4) finishing the sweatband body to form the sweatband. The sweatbands of the present invention can easily facilitate the movement of sweat away from the wearer, while still providing comfort and breathability.

19 Claims, 2 Drawing Sheets

(51) Int. Cl.

| | |
|---|---|
| ***D04B 1/16*** | (2006.01) |
| ***A41D 31/102*** | (2019.01) |
| ***A41D 31/12*** | (2019.01) |
| *D06M 101/32* | (2006.01) |

(56) References Cited

U.S. PATENT DOCUMENTS 2,375,971 A * 5/1945 Windschauer ..... D06B 3/04 118/405
2,776,435 A * 1/1957 Trimpert ..... A42B 1/02 2/175.5
2,939,201 A * 6/1960 Holland ..... D01D 5/253 66/202
3,224,225 A * 12/1965 Blore ..... D04B 15/34 66/24
4,444,710 A 4/1984 Most, Jr.
4,583,987 A * 4/1986 Kurz ..... D06P 1/0004 252/8.81
5,389,136 A * 2/1995 Danner ..... C08L 91/08 106/271
5,584,076 A * 12/1996 Armstrong ..... A42B 1/22 2/181.4
5,785,997 A * 7/1998 Budenbender ..... D01D 5/0885 264/178 R
6,395,394 B1 * 5/2002 Willemsen ..... D06M 7/00 252/8.61
6,472,019 B1 * 10/2002 Yamaguchi ..... D06M 13/262 427/354
7,018,425 B1 * 3/2006 Callaway ..... C08J 11/06 252/8.83
2005/0262643 A1 * 12/2005 Nogues Lopez ..... D06M 7/00 8/115.51
2009/0181599 A1 * 7/2009 Farmer ..... A41B 17/00 450/39
2011/0057143 A1 * 3/2011 Yamakita ..... D06M 7/00 252/8.84
2016/0262470 A1 * 9/2016 Blythe ..... A41D 20/00
2017/0233901 A1 * 8/2017 Ackroyd ..... D02G 3/04 57/244

OTHER PUBLICATIONS

Pending U.S. Appl. No. 15/581,231, filed Apr. 28, 2017.
Machine Translation of CN102162145, Jiqiang et al. (Year: 2011).
Machine Translation of JPH03234811, Shimizu (Year: 1991).
Office Action from co-pending U.S. Appl. No. 15/498,895; dated Feb. 7, 2019.
Office Action from co-pending U.S. Appl. No. 15/581,231; dated Apr. 5, 2019.

* cited by examiner

PROCESS FOR PRODUCING A KNITTED SWEATBAND

RELATED APPLICATIONS

This application claims the foreign priority benefit of Chinese Patent Application Serial No. 201710041546.5 filed on Jan. 20, 2017, the entire disclosure of which is incorporated herein by reference.

BACKGROUND

1. Field of the Invention

The present invention generally relates to the technical field of textile materials. More particularly, the present invention generally relates to processes for producing knitted articles.

2. Description of the Related Art

Generally, people like wearing a variety of hats for aesthetic purposes and to provide shade to the wearer. Thus, there is a wide variety of hats in the current market. Typically, almost every hat on today's market will contain a sweatband to absorb the sweat generated by the body of the wearer, thereby increasing the comfort of the wearer while wearing the hat.

Generally, conventional sweatbands in today's market comprise an elastic layer and a back sheet layer that are laminated together. Unfortunately, this sweatband configuration is not very elastic and does not stretch well.

Furthermore, conventional sweatbands are relatively thick and the elastic layers are usually made from a sponge material, which absorbs the sweat from the wearer via a springback process. Additionally, the back layer is usually made from a hydrophobic synthetic fiber material, such as a cloth or fabric. Due to the hydrophobicity of the back layer, the sweat is stored in the sponge of the elastic layer. Thus, the water vapor formed by sweat in the sponge is discharged through the pores of the back layer, but the sweat cannot be transferred between the sponge and the back layer and, therefore, sweat keeps accumulating in the sponge. Consequently, conventional sweatbands are only designed to absorb and hold the sweat from the wearer, thereby causing serious discomfort to the wearer over extended periods of time.

SUMMARY

One or more embodiments of the present invention are directed to a process for producing a sweatband. Generally, the process involves: (a) applying a wax onto a yarn to form a treated yarn, wherein the wax comprises a paraffin wax, a silicone oil, a white oil, and a rapeseed oil, wherein the yarn comprises at least one polyester filament; (b) twisting the treated yarn with at least one additional yarn to form a twisted yarn; (c) knitting the twisted yarn to thereby form a sweatband body; and (d) finishing the sweatband body to form the sweatband, wherein the finishing comprises ironing at least a portion of the sweatband body.

One or more embodiments of the present invention are directed to a process for producing a sweatband. Generally, the process involves: (a) applying a wax onto a yarn to form a treated yarn, wherein the yarn comprises at least two polyester filaments, wherein the wax comprises: (i) a paraffin wax, a silicone oil, a white oil, and a rapseseed oil, (ii) a weight ratio of the paraffin wax to the silicone oil, the white oil, and/or the rapeseed oil of at least 2:1, (iii) a weight ratio of the silicone oil to the white oil or the rapeseed oil of at least 1:1, and (iv) a weight ratio of the white oil to the rapeseed oil of at least 1:1; (b) twisting the treated yarn with at least one additional yarn to form a twisted yarn; (c) knitting the twisted yarn to thereby form a sweatband body; and (d) finishing the sweatband body to form the sweatband, wherein the finishing comprises ironing at least a portion of the sweatband body.

One or more embodiments of the present invention are directed to a knitted sweatband. Generally, the knitted sweatband comprises a yarn containing one or more polyester filaments, wherein the polyester filaments comprise a lobed-shape cross section that contains a plurality of lobes and a traverse aspect ratio of at least 1.5:1. Furthermore, the yarn is at least partially coated with a wax comprising: (i) a paraffin wax, a silicone oil, a white oil, and a rapeseed oil, (ii) a weight ratio of the paraffin wax to the silicone oil, the white oil, and/or the rapeseed oil of at least 2:1, (iii) a weight ratio of the silicone oil to the white oil or the rapeseed oil of at least 1:1, and (iv) a weight ratio of the white oil to the rapeseed oil of at least 1:1.

BRIEF DESCRIPTION OF THE FIGURES

Embodiments of the present invention are described herein with reference to the following drawing figures, wherein.

DETAILED DESCRIPTION

Figure 1:
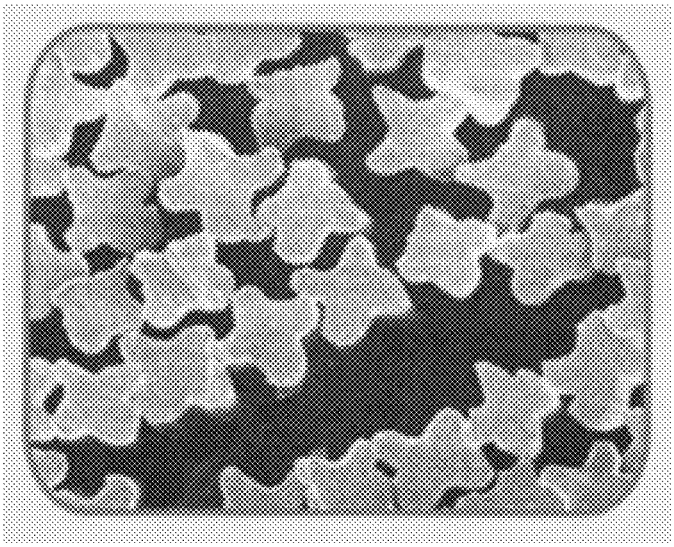
FIG. 1 depicts a cross-sectional view of the moisture-wicking polyester filaments.

The present invention generally relates to the production of knitted sweatbands that are lightweight, breathable, elastic, and facilitate the evaporation of sweat from the wearer. Generally, the manufacturing process for producing the knitted sweatbands broadly involves: (1) applying a continuous wax coating onto a polyester yarn; (2) twisting the yarn with one or more additional yarns to produce a twisted yarn; (3) knitting the twisted yarn into a sweatband body; and (4) finishing the sweatband body to form the knitted sweatband. The resulting sweatbands can exhibit superior elasticity and breathability and can be highly efficient in wicking sweat away from a wearer.

Each of the aforementioned steps of the inventive process for producing the knitted sweatbands are discussed in detail below.

The production process of the present invention begins by applying a wax coating on at least a portion of an initial yarn. The wax can be capable of protecting the surface of the yarn and enhancing the lubricity and smoothness of the yarn. In various embodiments, the wax can be coated onto the yarn using conventional machinery and techniques known in the art, such as a roll dipper. Furthermore, in one or more embodiments, multiple coats of the wax can be applied onto the yarn in order to ensure that the wax is continuously and uniformly coated on the yarn. For instance, the wax application step can involve applying at least 2, 3, or 4 coats of the wax onto the yarn.

The choice of yarn used in the process of the present invention is important and can directly influence many properties in the resulting sweatbands. Unlike other sweatband production processes, the production process of the present invention can use a thinner polyester yarn, which can result in a sweatband with a more consistent texture size.

In various embodiments, the initial yarn used in the wax application step comprises a yarn that comprises a single polyester filament or a plurality of polyester filaments. In certain embodiments, the initial yarn comprises, consists essentially of, or consists of at least 2, 3, or 4 polyester filaments. Additionally or alternatively, in various embodiments, the yarn can comprise an average denier in the range of 25 to 100 denier, 50 to 80 denier, or preferably about 75 denier. In one or more embodiments, the yarn can comprise a dyed polyester yarn.

In various embodiments, the polyester filaments may be produced from polyethylene terephthalate or derivatives thereof.

In one or more embodiments, the polyester filaments forming the yarns can comprise longitudinal grooves that function as capillaries, which facilitate the moisture wicking capabilities of the filament. For example, the polyester filaments can comprise a non-round cross-sectional shape, such as, for example, a lobed shape. In such embodiments, the polyester filaments can be non-round filaments having a lobed-shaped cross section, a clover leaf-shaped cross section, a triangular-shaped cross section, an X-shaped cross-section, or a flat-shaped cross section.

In one or more embodiments, the polyester filaments have a lobed-shape cross section. In various embodiments, the filaments have a cross-sectional lobed-shape comprising at least 1, 2, 3, 4, 5, 6, 7, or 8 lobes. In certain embodiments, the filaments have a lobed-shape cross section with 4 lobes. As shown in FIG. 1, the polyester filaments used to form the yarns of the present invention can comprise a lobed-shape cross section with 4 lobes.

In various embodiments, the polyester filaments used to form the yarns can have an average cross-sectional surface area of at least 50, 100, 200, 300, 400, or 500 $\mu m^2$ and/or not more than 10,000, 5,000, or 2,000 $\mu m^2$.

Figure 2:
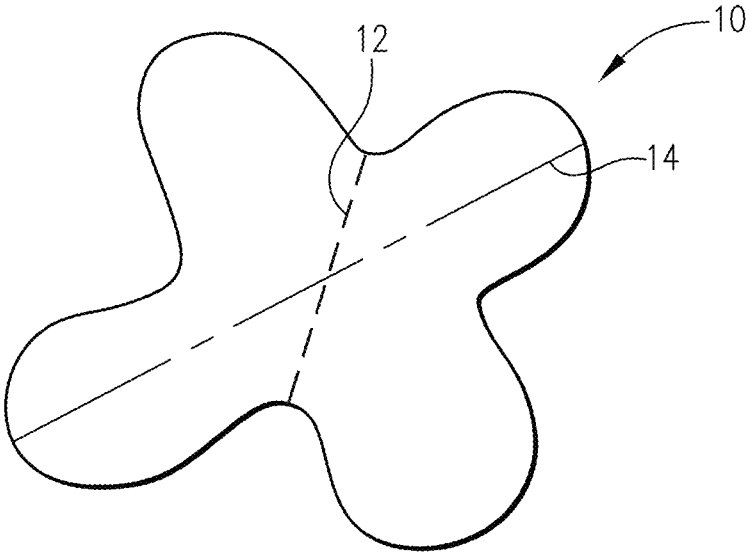
FIG. 2 depicts a cross-sectional view of a single moisture-wicking polyester filament.

In various embodiments, the polyester filaments may have a minimum transverse width of less than about 1,000, 750, 500, 400, 300, 200, 100, or 50 μm. Additionally or alternatively, the polyester filaments may have a maximum transverse width of less than about 10,000, 5,000, 2,000 μm, but greater than about 1,000, 750, 500, 400, 300, 200, 100, or 50 μm. As used herein, the "minimum transverse width" denotes the minimum cross-sectional width of a filament as measured perpendicular to the length of the filament. In addition, as used herein, the "maximum transverse width" denotes the maximum cross-sectional width of a filament as measured perpendicular to the length of the filament. FIG. 2 demonstrates how the minimum transverse width and maximum transverse width of the filaments may be measured. In particular, as shown in FIG. 2, the cross-section of the filament 10 comprises a minimum transverse width 12 and a maximum transverse width 14.

Typically, the minimum transverse width and the maximum transverse width should be nearly identical for polyester filaments having a round-shaped cross-section. However, these dimensions may greatly vary if filaments containing different cross-sectional shapes are used (e.g., lobed-shape). In one or more embodiments, the polyester filaments can have a transverse aspect ratio of at least 1:1, 1.25:1, 1.5:1, 1.75:1, 2:1, 3:1, 4:1, 5:1, 10:1, 50:1, or 100:1. Additionally or alternatively, the polyester filaments can have a transverse aspect ratio of less than 10,000:1, 5,000:1, 1,000:1, 500:1, 100:1, 50:1, 20:1, 10:1, 5:1, 4:1, 3:1, 2.5:1, 2:1, 1.75:1, or 1.5:1. As used herein, "transverse aspect ratio" denotes the ratio of a filament's maximum transverse width to the filament's minimum transverse width.

As noted above, the polyester filaments that form the initial yarns can improve the capillary effects of the fabrics produced from the yarns. In particular, the polyester filaments can comprise grooves along their longitudinal surface that facilitate this capillary function. More specifically, the longitudinal grooves can facilitate the movement of moisture within the fabric, thereby allowing the moisture to be moved from the wearer's skin to the surface of the fabric, where the moisture can begin to evaporate.

Furthermore, the type of wax utilized in the process of the present application can influence and affect various properties of the resulting sweatbands. In various embodiments, the wax comprises a paraffin wax, a silicone oil, a white oil, a rapeseed oil, or a mixture thereof. In certain embodiments, the wax comprises a paraffin wax, a silicone oil, a white oil, and a rapeseed oil. Additionally or alternatively, the wax can be in the form of a solid during the wax application step.

In one or more embodiments, the wax comprises at least 25, 50, 75, 80, or 85 weight percent and/or less than 99, 95, or 90 weight percent of at least one paraffin wax. In certain embodiments, the wax comprises about 90 weight percent of at least one paraffin wax.

In one or more embodiments, the wax comprises at least 0.5, 1, 2, or 6 weight percent and/or less than 99, 90, 75, 50, 25, or 10 weight percent of at least one silicone oil. In certain embodiments, the wax comprises about 6 weight percent of at least one silicone oil.

In one or more embodiments, the wax comprises at least 0.5, 1, 2, or 3 weight percent and/or less than 99, 90, 75, 50, 25, or 10 weight percent of at least one white oil. In certain embodiments, the wax comprises about 3 weight percent of a white oil. As used herein, "white oil" may be used interchangeably with mineral oil.

In one or more embodiments, the wax comprises at least 0.1, 0.5, or 1 weight percent and/or less than 99, 90, 75, 50, 25, 10, or 5 weight percent of a rapeseed oil. In certain embodiments, the wax comprises about 1 weight percent of rapeseed oil.

In certain embodiments, the wax comprises a weight ratio of paraffin wax to silicone oil, white oil, and/or rapeseed oil of at least 1:1, 2:1, 3:1, 4:1, 5:1, 6:1, 7:1, 8:1, 9:1, or 10:1 and/or less than 100:1, 75:1, or 50:1.

In certain embodiments, the wax comprises a weight ratio of silicone oil to rapeseed oil and/or white oil of at least 1:1, 2:1, 3:1, or 4:1.

In certain embodiments, the wax comprises a weight ratio of white oil to rapeseed oil of at least 0.5:1, 1:1, 2:1, or 3:1.

After the wax application step, the wax-treated yarn is subjected to a twisting step to form a twisted yarn. During the twisting step, the wax-treated yarn may be twisted by itself or with one or more additional yarns. In various embodiments, the twisting step involves twisting the wax-treated yarn with at least 1, 2, 3, or 4 additional yarns. Additionally or alternatively, the twisting step involves twisting the wax-treated yarn with less than 100, 50, 25, 10, or 4 additional yarns. In certain embodiments, the twisted yarns can comprise 2 to 4 yarns overall. In such embodiments, these additional yarns can comprise or consist of the wax-treated yarns described above. Alternatively, the additional yarns can comprise yarns that are different than the wax-treated polyester yarns described above. For instance, the additional yarns can comprise wool yarns, cotton yarns, or other types of polyester yarns.

In various embodiments, the twisted yarn can have a twists per inch ("TPI") of at least 40, 50, 60, 70, or 80 and/or less than 300, 250, 200, 150, 120, or 100. In certain embodiments, the twisted yarn comprises a TPI in the range of 80 to 100.

The twisting step can be carried out using any conventional twisting machine known in the art.

In various embodiments, the twisted yarn may have a Z-twist or an S-twist.

After the twisting step, the twisted yarn can then be subjected to a knitting step to form a sweatband body. In one or more embodiments, the knitting step can produce a knitted sweatband body entirely from the twisted yarn of the present invention. Alternatively, the knitting step can combine the twisted yarn of the present invention with other types of yarns, such as cotton yarns, wool yarns, or other types of polyester yarns. In one or more embodiments, the knitting step can involve a flat weaving process.

Furthermore, in various embodiments, the twisted yarns used in the knitting step can be dyed different colors. Thus, the resulting knitted article can comprise 2 or more colors. In such embodiments, the woven article can be a multicolored article. Consequently, this can allow one to modify the resulting knitted articles accordingly to enhance the aesthetic properties of the knitted sweatbands.

In certain embodiments, this knitting step can be carried out with a computerized flat knitting machine comprising 10 to 14 needles. In such embodiments, the knitting step can involve weaving an air layer via an intermediate turn of one or two needles. Generally, in such embodiments, a tuck connection can be needed in the middle of the sweatband body.

In various embodiments, the sweatband body from the knitting step can comprise a fabric, such as an air layer fabric. In one or more embodiments, the fabrics may exhibit a vertical wicking height as measured according to AATCC-79 of at least 75, 80, 85, 90, 95, 100, 105, or 110 mm/10 minutes. Additionally or alternatively, the woven fabrics produced from the inventive polyester yarns may exhibit a water diffusion area of at least 1,500, 1,600, 1,700, or 1,800 $mm^2$/30 seconds.

After the knitting step, the sweatband body can then be subjected to a finishing step to produce the final sweatband. In various embodiments, this finishing step can involve subjecting the sweatband body to ironing. In one or more embodiments, this ironing step can involve the use of styling plates that shape the sweatband body into the sweatband. Furthermore, in various embodiments, it is generally preferable that the iron does not come into direct contact with the sweatband body during the ironing step. In particular, it is preferred that a space of 1 to 2 cm be maintained between the iron and the sweatband body during the ironing step.

In various embodiments, the ironing plates during the ironing step can be maintained at a temperature of at least 60, 75, or 100° C. and/or less than 200, 175, or 140° C. Additionally or alternatively, the steam pressure from the ironing plates can be maintained at a pressure of at least 1.5, 2, or 3 N/$cm^2$ and/or less than 8, 6, or 5 N/$cm^2$. In certain embodiments, the ironing plates can be maintained at a temperature in the range of 100 to 140° C. and a pressure in the range of 3 to 5 N/$cm^2$.

In one or more embodiments, the ironing step can occur for at least 30, 40, or 50 seconds and/or less than 90, 80, or 70 seconds. In certain embodiments, the ironing step can occur over a period of 50 to 70 seconds. After the ironing step, the ironed article can be subjected to drainage suction and then dry steam to make the final form of the resulting sweatband.

The resulting sweatbands of the present invention can exhibit desirable elasticity and breathability without the need for an additional tailoring process that attaches a backing material to the sweatband. Thus, the inventive sweatbands are able to effectively function without the need of an additional back layer to support it.

As noted above, the sweatbands of the present invention can exhibit desirable elasticity. For instance, the sweatbands of the present invention can exhibit an elasticity loss of less than 5, 4, 3, 2, 1.5, 1, or 0.5 cm. The elasticity loss is measured by stretching a 10 cm long sample of the finished sweatband to 20 cm by hand, releasing the sample once it has been stretched to 20 cm, and measuring the rebound length of the sample after 15 seconds. The elasticity of loss is measured by subtracting the original sample length (10 cm) from the rebound length. For example, if the tested sample had a rebound length of 12 cm, then the resulting sample exhibited an elasticity loss of 2 cm.

Furthermore, in various embodiments, the sweatbands of the present invention can exhibit superior air permeability. For instance, the sweatbands can exhibit an air permeability of at least 10, 12, 14, 15, 16, or 17 mm/s as measured by a Yg461-type air permeability tester according to GB/T 5453-1997 requirements.

This invention can be further illustrated by the following examples of embodiments thereof, although it will be understood that these examples are included merely for the purposes of illustration and are not intended to limit the scope of the invention unless otherwise specifically indicated.

EXAMPLES

Example 1

A knitted sweatband was produced in accordance with the following process. First, a 75 denier polyester yarn was subjected to three separate wax coating applications with a wax mixture in order to form a wax-treated yarn that was evenly covered with the wax. The polyester yarn was formed from polyester filaments having a lobed-shape cross section with four lobes. The wax mixture comprised a paraffin wax, silicone oil, a white oil, and a rapeseed oil at a weight ratio of 90:6:3:1, respectively. After the wax application step, the wax-treated yarn was then twisted with 3 other polyester yarns to form a twisted yarn having a TPI of 100. Subsequently, the twisted yarn was then knitted into an air layer weave with a 14-pin computer knitting machine. The resulting air layer wave formed the sweatband body. After the knitting step, the sweatband body was subjected to finishing via ironing. During the ironing step, the sweatband body was pressed with an iron at a temperature of about 100° C., a pressure of 5 N/$cm^2$, and a setting time of 70 seconds. After ironing, the sweatband was subjected to drainage suction and dry steam.

The elasticity loss of the resulting sweatband was measured by taking a 10 cm long sample of the sweatband, stretching the sample to 20 cm, and then measuring the rebound length after 15 seconds. According to this test, the sweatband exhibited a rebound length of 11.5 cm and, therefore, exhibited an elasticity loss of 1.5 cm. Thus, the sweatband exhibited good elasticity.

In addition, the air permeability of the sweatband was measured using a Yg461 air permeability tester according to GB/T5453-1997 requirements at a pressure drop of 200 Pa. The sweatband exhibited an air permeability of 16.8 mm/s, which indicated that the sweatband contained excellent breathability properties.

Example 2

A knitted sweatband was produced in accordance with the following process. First, a 75 denier polyester yarn was subjected to four separate wax coating applications with a wax mixture in order to form a wax-treated yarn that was evenly covered with the wax. The polyester yarn was formed from polyester filaments having a lobed-shape cross section with four lobes. The wax mixture comprised a paraffin wax, silicone oil, a white oil, and a rapeseed oil at a weight ratio of 90:6:3:1, respectively. After the wax application step, the wax-treated yarn was then twisted with 2 other polyester yarns to form a twisted yarn having a TPI of 90. Subsequently, the twisted yarn was then knitted into an air layer weave with a 10-pin computer knitting machine. The resulting air layer wave formed the sweatband body. After the knitting step, the sweatband body was subjected to finishing via ironing. During the ironing step, the sweatband body was pressed with an iron at a temperature of about 140° C., a pressure of 3 N/cm$^2$, and a setting time of 50 seconds. After ironing, the sweatband was subjected to drainage suction and dry steam.

The elasticity loss of the resulting sweatband was measured by taking a 10 cm long sample of the sweatband, stretching the sample to 20 cm, and then measuring the rebound length after 15 seconds. According to this test, the sweatband exhibited a rebound length of 11 cm and, therefore, exhibited an elasticity loss of 1 cm. Thus, the sweatband exhibited good elasticity.

In addition, the air permeability of the sweatband was measured using a Yg461 air permeability tester according to GB/T5453-1997 requirements at a pressure drop of 200 Pa. The sweatband exhibited an air permeability of 17.2 mm/s, which indicated that the sweatband contained excellent breathability properties.

Example 3

A knitted sweatband was produced in accordance with the following process. First, a 75 denier polyester yarn was subjected to two separate wax coating applications with a wax mixture in order to form a wax-treated yarn that was evenly covered with the wax. The polyester yarn was formed from polyester filaments having a lobed-shape cross section with four lobes. The wax mixture comprised a paraffin wax, silicone oil, a white oil, and a rapeseed oil at a weight ratio of 90:6:3:1, respectively. After the wax application step, the wax-treated yarn was then twisted with one other polyester yarns to form a twisted yarn having a TPI of 80. Subsequently, the twisted yarn was then knitted into an air layer weave with a 12-pin computer knitting machine. The resulting air layer wave formed the sweatband body. After the knitting step, the sweatband body was subjected to finishing via ironing. During the ironing step, the sweatband body was pressed with an iron at a temperature of about 120° C., a pressure of 4 N/cm$^2$, and a setting time of 60 seconds. After ironing, the sweatband was subjected to drainage suction and dry steam.

The elasticity loss of the resulting sweatband was measured by taking a 10 cm long sample of the sweatband, stretching the sample to 20 cm, and then measuring the rebound length after 15 seconds. According to this test, the sweatband exhibited a rebound length of 10.5 cm and, therefore, exhibited an elasticity loss of 0.5 cm. Thus, the sweatband exhibited good elasticity.

In addition, the air permeability of the sweatband was measured using a Yg461 air permeability tester according to GB/T 5453-1997 requirements at a pressure drop of 200 Pa. The sweatband exhibited an air permeability of 18.3 mm/s, which indicated that the sweatband contained excellent breathability properties.

Example 4

The water absorption of the knitted sweatbands from Examples 1-3 were compared to a conventional sweatband of Example 1-3. The conventional sweatband contained a cotton twill fabric backing layer with a sponge laminated thereon. For these tests, the tested sweatband sample was inclined at a 45 degree angle relative to the surface of a table and water was dropped on the sample. An equal amount of water was dropped onto each sample and it was observed how much of the water absorbed into the sweatband. These tests were performed five times for each sample. The extent of the water adsorption was measured by measuring the water mark length on each sweatband, which was measured from a predetermined line on each sample. The results show that the sweatbands of Examples 1-3 had a water mark length of 4.07 cm, 4.16 cm, and 3.87 cm, respectively. In contrast, the conventional sweatband had a water mark length of 7.25 cm, which is highly undesirable.

Example 5

Woven fabrics were produced from conventional nylon filaments, conventional round PET filaments, conventional cotton filaments, and the inventive polyester yarns comprising lobed-shape filaments described above. The moisture absorption and wicking properties of the fabrics were tested and compared.

Figure 3:
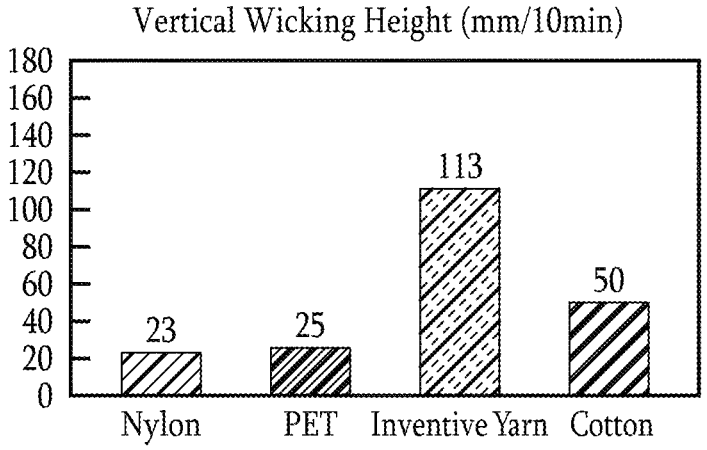
FIG. 3 is a bar graph depicting the Vertical Wicking Heights of various tested fabrics produced from nylon fibers, conventional polyethylene terephthalate (PET) fibers, cotton fibers, and the inventive polyester filaments.

The vertical wicking height (mm/10 minutes) was measured according to AATCC-79 for each of the produced fabrics. The test method for measuring the vertical wicking height comprised cutting the test fabrics into sample pieces having a size of 20 cm by 2.5 cm and submerging a designated portion of the sample fabric in a tank holding water. The tank was installed on a horizontal bar and the temperature of the water in the tank was maintained at 18 to 22° C. The samples were removed from the tank after 10 and 30 minutes in order to measure the rise of water in the portions of the fabric that were not submerged in the water. Consequently, this allowed one to observe the capillary effects of the filaments making up the fabrics. The rise of the water was measured from the designated submerge line to the top vertical height that the water reached in the fabric. These measurements were taken after 10 and 30 minutes. A measurement was repeated five times and the average value was calculated. As shown in FIG. 3, the fabric produced from the inventive polyester filament exhibited a significant higher wicking height after 10 minutes (113 mm/10 minutes) compared to fabrics produced from conventional nylon, PET, and cotton yarns.

Figure 4:
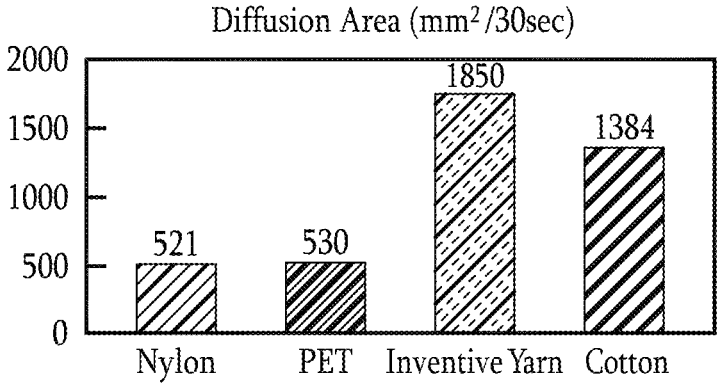
FIG. 4 is a bar graph depicting the Water Droplet Diffusion Areas of various tested fabrics produced from nylon fibers, conventional polyethylene terephthalate (PET) fibers, cotton fibers, and the inventive polyester filaments.

In addition, the water droplet diffusion area of the fabrics was also tested in order to further analyze the moisture wicking capabilities of the inventive polyester yarns. For this test, the fabric samples were flattened and suspended in the air. Next, 0.2 mL of water was dropped onto the sample and the diffusion area of the water on the fabric was measured with a ruler after 30 seconds. As shown in FIG. 4, the fabric produced from the inventive polyester yarns outperformed fabrics produced from conventional nylon, PET, and cotton yarns.

As can be seen in FIGS. 3 and 4, fabrics produced from the inventive polyester yarns exhibited better moisture absorption and wetting effects compared to fabrics produced from conventional nylon, PET, and cotton yarns. Consequently, this would result in a fabric that would be more comfortable to the wearer.

Definitions

It should be understood that the following is not intended to be an exclusive list of defined terms. Other definitions may be provided in the foregoing description, such as, for example, when accompanying the use of a defined term in context.

As used herein, the terms "a," "an," and "the" mean one or more.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination, B and C in combination; or A, B, and C in combination.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "having," "has," and "have" have the same open-ended meaning as "comprising," "comprises," and "comprise" provided above.

As used herein, the terms "including," "include," and "included" have the same open-ended meaning as "comprising," "comprises," and "comprise" provided above.

As used herein, "about" means that the recited value can deviate by 10 percent from the recited value. For instance, "about 1" would cover a range of 0.9 to 1.1.

Numerical Ranges

The present description uses numerical ranges to quantify certain parameters relating to the invention. It should be understood that when numerical ranges are provided, such ranges are to be construed as providing literal support for claim limitations that only recite the lower value of the range as well as claim limitations that only recite the upper value of the range. For example, a disclosed numerical range of 10 to 100 provides literal support for a claim reciting "greater than 10" (with no upper bounds) and a claim reciting "less than 100" (with no lower bounds).

CLAIMS NOT LIMITED TO DISCLOSED EMBODIMENTS

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

What is claimed is:

1. A process for the production of a sweatband, wherein the process comprises:

(a) applying a wax onto a yarn to form a treated yarn, wherein the wax comprises a paraffin wax, a silicone oil, a white oil, and a rapeseed oil, wherein the yarn comprises at least one polyester filament;

(b) twisting the treated yarn with at least one additional yarn to form a twisted yarn;

(c) knitting the twisted yarn to thereby form a sweatband body; and (d) finishing the sweatband body to form the sweatband, wherein the finishing comprises ironing at least a portion of the sweatband body, wherein the wax comprises: (i) 25 to 95 weight percent of the paraffin wax, (ii) 1 to 50 weight percent of the silicone oil, (iii) 0.5 to 50 weight percent of the white oil, and (iv) 0.1 to 25 weight percent of the rapeseed oil.

2. The process of claim 1, wherein the polyester filament comprises a plurality of lobes.

3. The process of claim 2, wherein the polyester filament comprises a transverse aspect ratio of at least 1.5:1.

4. The process of claim 1, wherein the sweatband exhibits a vertical wicking height of at least 100 mm/10 minutes and a diffusion area of at least 1,700 $mm^2$/30 seconds.

5. The process of claim 1, wherein the yarn has an average denier in the range of 25 to 100 denier.

6. The process of claim 1, wherein the twisting of step (b) comprises twisting the treated yarn with 2 to 4 additional yarns.

7. The process of claim 1, wherein the wax comprises:

(i) 50 to 90 weight percent of the paraffin wax, (ii) 2 to 10 weight percent of the silicone oil, (iii) 1 to 10 weight percent of the white oil, and (iv) 0.5 to 10 weight percent of the rapeseed oil.

8. The process of claim 1, wherein at least a portion of the knitting of step (c) is carried out by a flat knitting machine.

9. A process for the production of a sweatband, wherein the process comprises:

(a) applying a wax onto a yarn to form a treated yarn, wherein the yarn comprises at least two polyester filaments, wherein the wax comprises:

(i) a paraffin wax, a silicone oil, a white oil, and a rapseseed oil, (ii) a weight ratio of the paraffin wax to the silicone oil, the white oil, and/or the rapeseed oil of at least 2:1, (iii) a weight ratio of the silicone oil to the white oil or the rapeseed oil of at least 1:1, and (iv) a weight ratio of the white oil to the rapeseed oil of at least 1:1;

(b) twisting the treated yarn with at least one additional yarn to form a twisted yarn;

(c) knitting the twisted yarn to thereby form a sweatband body; and (d) finishing the sweatband body to form the sweatband, wherein the finishing comprises ironing at least a portion of the sweatband body.

10. The process of claim 9, wherein the polyester filaments comprise a plurality of lobes.

11. The process of claim 10, wherein the polyester filaments comprise a transverse aspect ratio of at least 1.5:1.

12. The process of claim 9, wherein the sweatband exhibits a vertical wicking height of at least 100 mm/10 minutes and a diffusion area of at least 1,700 $mm^2$/30 seconds.

13. The process of claim 9, wherein the yarn has an average denier in the range of 25 to 100 denier.

14. The process of claim 9, wherein the twisting of step (b) comprises twisting the treated yarn with 2 to 4 additional yarns.

15. The process of claim 9, wherein the wax comprises:
(i) 25 to 95 weight percent of the paraffin wax,
(ii) 1 to 50 weight percent of the silicone oil,
(iii) 0.5 to 50 weight percent of the white oil, and
(iv) 0.1 to 25 weight percent of the rapeseed oil.

16. The process of claim 9, wherein the wax comprises:
(i) 50 to 95 weight percent of the paraffin wax,
(ii) 2 to 10 weight percent of the silicone oil,
(iii) 1 to 10 weight percent of the white oil, and
(iv) 0.5 to 10 weight percent of the rapeseed oil.

17. A knitted sweatband, wherein the knitted sweatband comprises a yarn containing one or more polyester filaments,
wherein the polyester filaments comprise a plurality of lobes,
wherein the polyester filaments comprise a transverse aspect ratio of at least 1.5:1,
wherein the yarn is at least partially coated with a wax comprising:
(i) a paraffin wax, a silicone oil, a white oil, and a rapeseed oil,
(ii) a weight ratio of the paraffin wax to the silicone oil, the white oil, and/or the rapeseed oil of at least 2:1,
(iii) a weight ratio of the silicone oil to the white oil or the rapeseed oil of at least 1:1, and
(iv) a weight ratio of the white oil to the rapeseed oil of at least 1:1.

18. The knitted sweatband of claim 17, wherein the wax comprises:
(i) 25 to 95 weight percent of the paraffin wax,
(ii) 1 to 50 weight percent of the silicone oil,
(iii) 0.5 to 50 weight percent of the white oil, and
(iv) 0.1 to 25 weight percent of the rapeseed oil.

19. The knitted sweatband of claim 17, wherein the wax comprises:
(i) 50 to 95 weight percent of the paraffin wax,
(ii) 2 to 10 weight percent of the silicone oil,
(iii) 1 to 10 weight percent of the white oil, and
(iv) 0.5 to 10 weight percent of the rapeseed oil.

* * * * *